US005775039A

United States Patent [19]

McPherson

[11] Patent Number: 5,775,039

[45] Date of Patent: Jul. 7, 1998

[54] DRAINAGE DEVICE

[75] Inventor: Kevin McPherson, Edwardsville, Ill.

[73] Assignee: Glenna Sue Bruns, Troy, Ill.

[21] Appl. No.: 646,918

[22] Filed: May 8, 1996

[51] Int. Cl.[6] ..... E04B 17/00

[52] U.S. Cl. ..... 52/169.5; 52/302.3; 52/171.1; 52/746.1

[58] Field of Search ..... 52/169.5, 302.1, 52/302.3, 171.1, 306, 793.1, 746.1; 428/178, 179, 180

[56] References Cited

U.S. PATENT DOCUMENTS

| | | | |
|---|---|---|---|
| D. 329,297 | 9/1992 | Smith | 25/138 |
| 3,283,460 | 11/1966 | Patrick | 52/274 |
| 3,850,193 | 11/1974 | Guzzo | 137/362 |
| 3,852,925 | 12/1974 | Gazzo | 52/169 |
| 3,888,087 | 6/1975 | Bergsland | 61/11 |
| 4,045,964 | 9/1977 | Barclay | 61/11 |
| 4,245,443 | 1/1981 | Beechen | 52/302.3 |
| 4,381,630 | 5/1983 | Koester | 52/169.5 |
| 4,604,842 | 8/1986 | Sukup | 52/263 |
| 4,674,249 | 6/1987 | Bennett, Jr. | 52/302 |
| 4,715,743 | 12/1987 | Schmanski | 404/9 |
| 4,745,716 | 5/1988 | Kuypers | 52/169.5 |
| 4,837,991 | 6/1989 | Shaw | 52/169.5 X |
| 4,840,515 | 6/1989 | Freese | 405/45 |
| 4,869,032 | 9/1989 | Geske | 52/302.3 |
| 4,925,342 | 5/1990 | Hendy | 52/169.5 X |
| 5,030,343 | 7/1991 | Urriola | 210/170 |
| 5,184,437 | 2/1993 | Woong et al. | 52/169.5 |
| 5,460,867 | 10/1995 | Magnuson et al. | 52/169.5 X |
| 5,501,044 | 3/1996 | Janesky | 52/302.3 X |

*Primary Examiner*—Beth Aubrey

*Attorney, Agent, or Firm*—Senniger, Powers, Leavitt & Roedel

[57] ABSTRACT

A drainage device for use under a floor in a structure including the floor, a foundation wall, a footing located below the foundation wall and a drain. The drainage device is constructed for placement on the footing adjacent to the foundation wall prior to installation of the floor to permit water to flow along the footing under the floor to the drain. The drainage device includes a wall member and spaced apart feet depending from the wall member. The feet are engageable with the footing at spaced apart locations for vertically spacing the wall member from the footing. The feet define fluid flow channels for water seeping from between the foundation wall and the footing and allow water to flow freely underneath the floor and along the footing toward the drain. The wall member being formed of a material capable of transmitting light in the visual range so that any foreign matter located below the wall member and potentially blocking the channels will be apparent upon visual inspection from above the drainage device prior to installing the floor over the drainage device.

20 Claims, 4 Drawing Sheets

DRAINAGE DEVICE

BACKGROUND OF THE INVENTION

This invention relates generally to drainage systems and more particularly to drainage devices for use in providing a flow path below basement floors for water seeping in between foundation walls and footing to prevent water leakage onto basement floors.

A problem in many basements is that of wet or damp basement floors caused by water seeping under the foundation wall and flowing up between the foundation wall and the basement floor. It is not practical, or even desirable, to prevent water from seeping under the foundation wall. Water pressure build up behind the wall can damage the wall. Therefore, drainage systems are used to provide a flow path for water entering between the foundation wall and footing to a sump, thus preventing the water from flowing up between the foundation wall and basement floor.

Presently available drainage systems include drainage devices in the form of tiles, over which the basement concrete floor is poured. Prior drainage devices, such as those shown in U.S. Patent Nos. Des. 329,297 and 4,745,716, have a flat wall member and a plurality of feet extending downward therefrom and engaging the footing to create flow paths for the water between the floor and footing. These tiles are laid along the footing prior to the concrete basement floor being poured and frequently lay uncovered for extended periods of time. During this period of time prior to the concrete being poured, rock and dirt may collect under the wall member within the flow paths, for example if the ground is wet due to rain or if surrounding dirt is being displaced while construction is taking place. This results in the flow passages being blocked when the concrete is finally poured. Blockage of the flow passages will prevent water from flowing to the drain and cause a build up of pressure resulting in water being forced up along the foundation wall and collecting on the basement floor. One way to check for accumulation of debris under the tile prior to pouring the floor material is to remove the nails which hold down the tiles and pull each tile back away from the footing to examine the surface below. This is time consuming and therefore seldom done. Alternatively, a person could run their hand under the edge of the tile, however, this is imprecise and dangerous since there are occasionally sharp objects hidden under the edge margin of the tile.

Accordingly, there is a need for a drainage system which is easily inspected for blockage of the flow passages prior to the pouring of the concrete floor.

SUMMARY OF THE INVENTION

Among the several objects of this invention may be noted the provision of a drainage device that can be visually inspected for blockage of flow passages; the provision of such a drainage device which is less likely to remain blocked after installation; the provision of such a drainage device which can be rapidly inspected for blockage; the provision of a drainage device that is inexpensive to manufacture; and the provision of a drainage device that is easy to install.

A drainage device of this invention is for use under a floor in a structure including the floor, a foundation wall, a footing located below the foundation wall and a drain. The drainage device is constructed for placement on the footing adjacent to the foundation wall prior to installation of the floor to permit water to flow along the footing under the floor to the drain. Generally, the drainage device comprises a wall member and spaced apart feet depending from the wall member. The feet are engageable with the footing at spaced apart locations for vertically spacing the wall member from the footing. The feet define fluid flow channels for water seeping between the foundation wall and the footing, and allow water to flow freely underneath the floor and along the footing toward the drain. The wall member is formed of a material capable of transmitting light in the visual range so that any foreign matter located below the wall member and potentially blocking the channels will be apparent upon visual inspection prior to installing the floor over the drainage device.

A method of this invention includes installing a drainage system under a floor in a structure including the floor, a foundation wall, a footing located below the foundation wall and a drain. The drainage device is constructed for placement on the footing adjacent to the foundation wall prior to installation of the floor to permit water to flow along the footing under the floor to the drain. The method includes placing drainage devices on the footing so that the drainage devices substantially cover the exposed footing. The method further includes visually inspecting the flow channels from above the footing by looking through the drainage device to detect blockage of the flow channels and pouring material to form the floor over the drainage devices if the flow channels are clear of any blockage other objects and features will be in part apparent and in part pointed out hereinafter.

BRIEF DESCRIPTION OF THE DRAWINGS

Corresponding parts are designated by corresponding reference numerals in the several views of the drawings.

DETAILED DESCRIPTION OF THE PREFERRED EMBODIMENT

Figure 1:
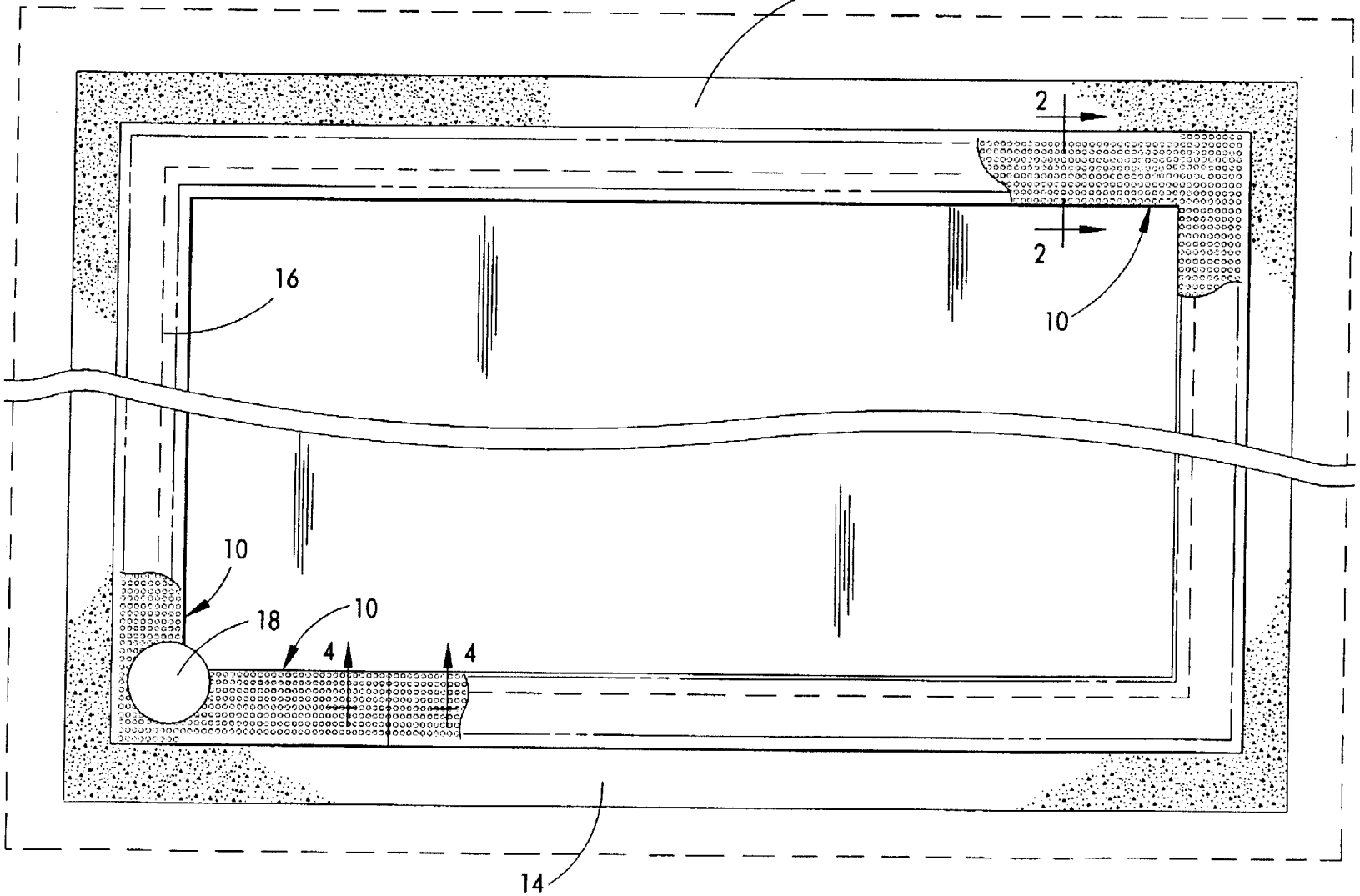
FIG. 1 is a top plan view of a drainage device of this invention installed in a structure.
Figure 2:
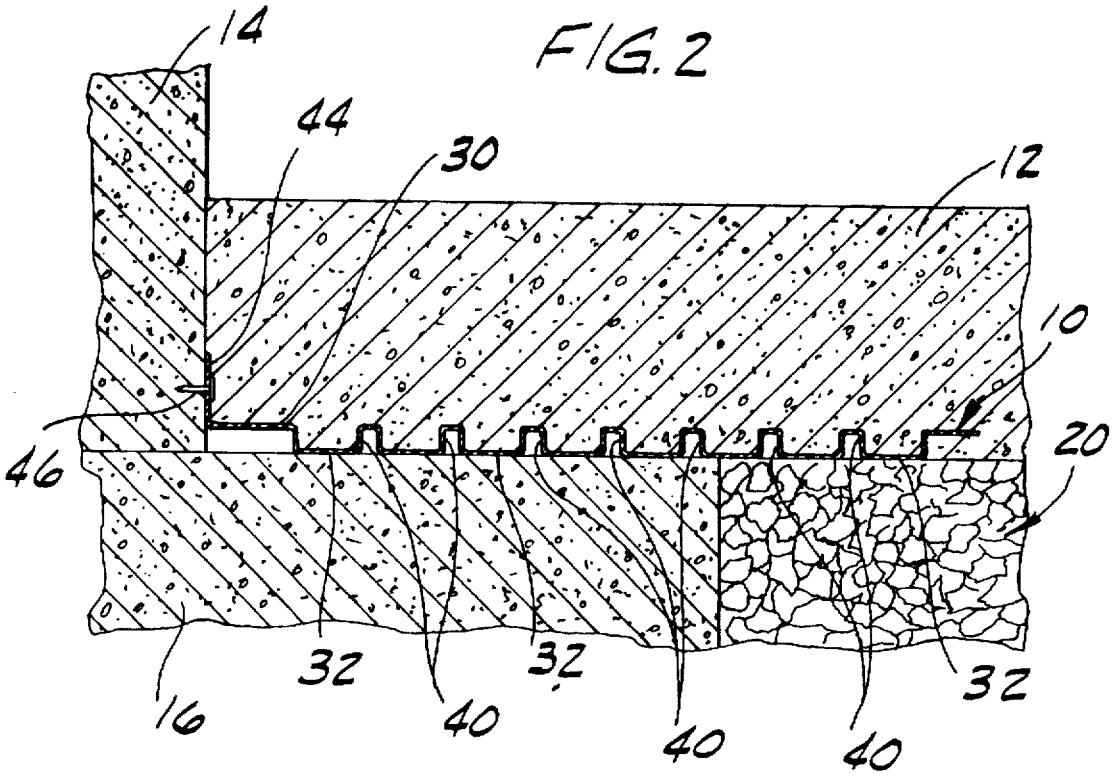
FIG. 2 is an enlarged, fragmentary cross-sectional view of the drainage device and structure taken in the plane including line 2—2 of FIG. 1.

Referring now to the drawings, and first to FIGS. 1 and 2, there is generally indicated at 10 a drainage device of this invention. The drainage device 10 is for use under a floor 12 in a structure (e.g., a residence) including the floor, a foundation wall 14, and a footing 16 located below the foundation wall (FIG. 2). The drainage device 10 is constructed for placement on the footing 16 adjacent to the foundation wall 14 prior to installation of the floor 12 to permit water to flow along the footing under the floor to the drain 18 (FIG. 1). The structure is formed in a conventional manner with the footing 16 and foundation wall 14 typically formed of concrete. The footing 16 extends around the perimeter of the structure and supports the foundation wall 14. The footing 16 also extends beyond the foundation wall into the interior of the structure for supporting a peripheral edge of the basement floor 12 located around the outer perimeter of the floor. The remaining portion of the floor 12 is supported by a layer of rock and dirt generally indicated at 20. The drain 18 is typically located at one corner of the structure and includes openings which allow water or other liquid to enter it and flow through it and be conveyed to a drainage area exterior to the structure. The water may flow through the drain 18 to a lower point by means of gravity or may be directed to a sump pump or similar device (not shown) which will pump the water to an outside area or sewer. The drainage device 10 may be used in buildings such as residential houses, commercial buildings, factories or any other building having a similar structural arrangement.

Figure 4:
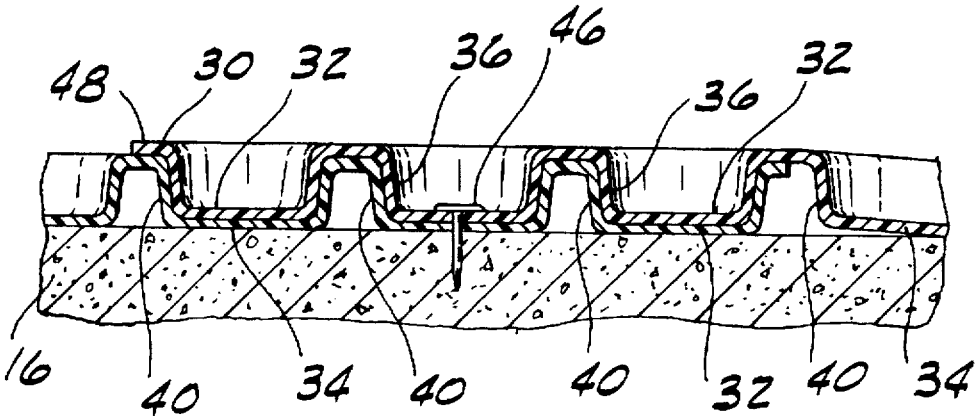
FIG. 4 is an enlarged, fragmentary cross-sectional view taken in the plane including line 4—4 of FIG. 1.
Figure 3:
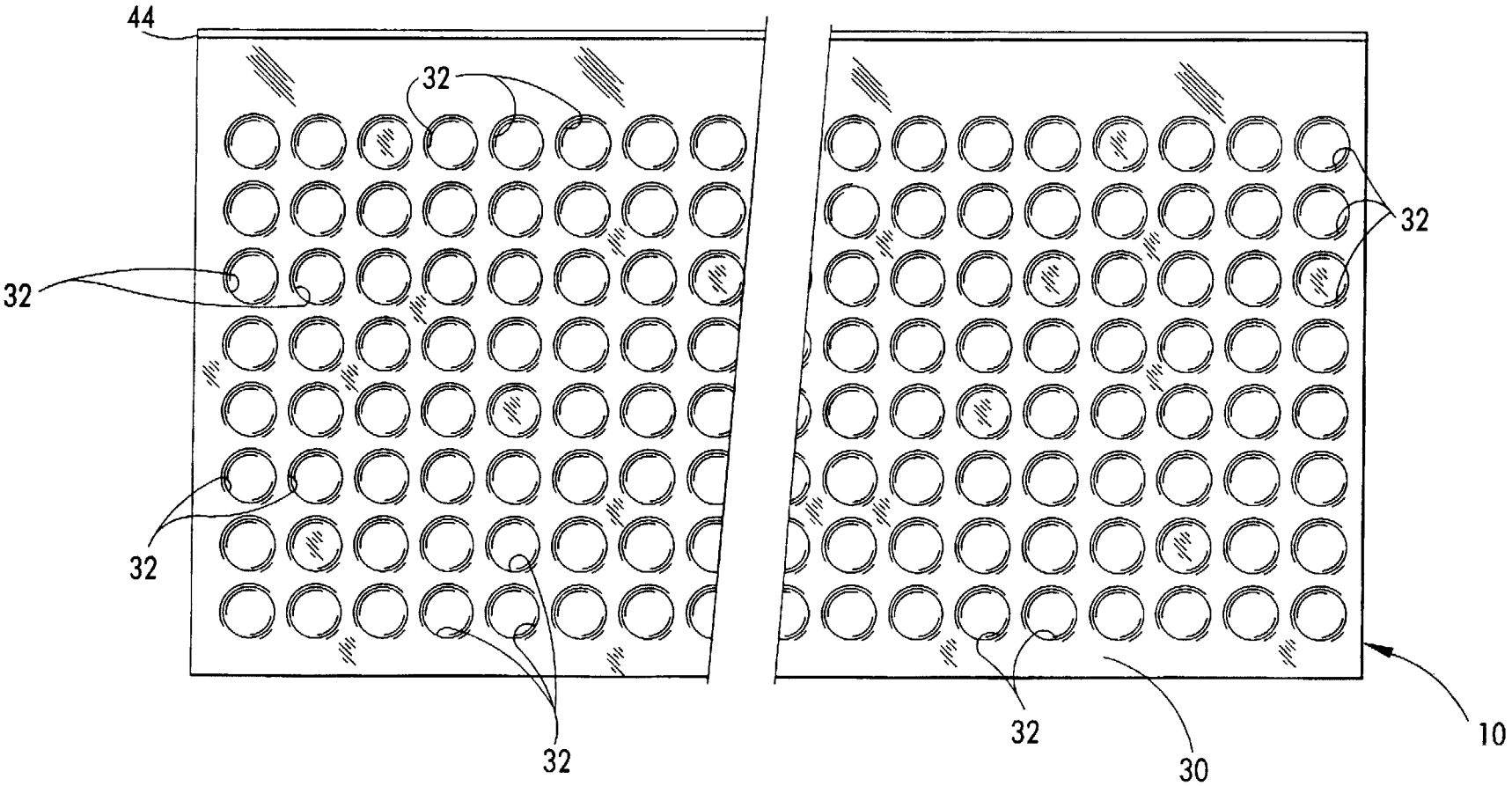
FIG. 3 is a top plan view of the drainage device of FIG. 1.

Referring now also to FIG. 3, the drainage device 10 comprises a wall member 30 and spaced apart feet 32 depending from the wall member. The wall member 30 is preferably rectangular in shape and has a width greater than the distance from the foundation wall 14 to the end of the footing 16 (e.g., typically 12 inches in a house). The feet 32 are hollow and open upwardly through the wall member 30 for receiving material poured to form the floor 12 whereby the weight of the floor is supported by the floor material within the feet and not by the wall member. Each foot 32 comprises a bottom wall 34 and a sidewall 36 which is generally cylindrically shaped (although the sidewall 36 may be slightly frustoconical), as shown in FIGS. 3 and 4. The cylindrical shape of the feet 32 facilitates the admission of rock in the concrete into the feet, thereby providing a stronger support of the floor from the footing. It is to be understood that the feet 32 may be rectangular or other suitable shapes without departing from the scope of this invention. The bottom walls 34 of the feet 32 are generally parallel with the wall member 30 and are engageable with the footing 16 at spaced apart locations for vertically spacing the wall member from the footing. The feet 32 define fluid flow channels 40 for water seeping from between the foundation wall 14 and the footing 16 and allow water to flow freely underneath the floor 12 and along the footing toward the drain 18. The placement of the feet 32 is such that the flow channels 40 allow water to travel both longitudinally and laterally with respect to each foundation wall 14. The flow paths 40 allow the water to travel to the drain 18 where it can flow to an area exterior to the structure rather than up between the foundation wall 14 and floor 12. The size and number of feet 32 may vary as long as there is enough surface area provided by the feet to allow for adequate support for the wall member 30 upon pouring the floor material over the drainage devices 10. For example, in the preferred embodiment the feet 32 are 0.75 inch in diameter, 0.25 inches in height, and spaced 0.25 inches apart. Most preferably, the interior diameter of the feet 32 is 0.625 inches or greater to permit ¾ inch rock (which is most commonly used in concrete for flooring) to be received in the foot 32 and contact its bottom wall 34 for supporting the floor. It is to be understood that the feet 32 may vary in size and spacing without departing from the scope of this invention. The height of the feet 32 should be large enough to provide adequate flow rates through the flow channels 40 so that under worse case conditions the water will be permitted to flow freely to the drain 18 and flow or be pumped outside of the structure without causing pressure to build up due to water entering the structure at a faster rate than it can be removed. The wall member 30 and feet 32 are preferably integrally formed from a thin (e.g., 0.06 in.) single sheet of material (e.g., ptherlate glycol, "PETG" plastic). The drainage device 10 may be formed from a polymeric material or other suitable material which is impervious to water and strong enough to retain its shape after the concrete floor is poured and until the floor 12 sets. The drainage device 10 is preferably sized to extend outwardly beyond the footing 16 so that a portion of the drainage device 10 covers the rock 20 to permit flow of water between the footing and the rock.

Figure 5:
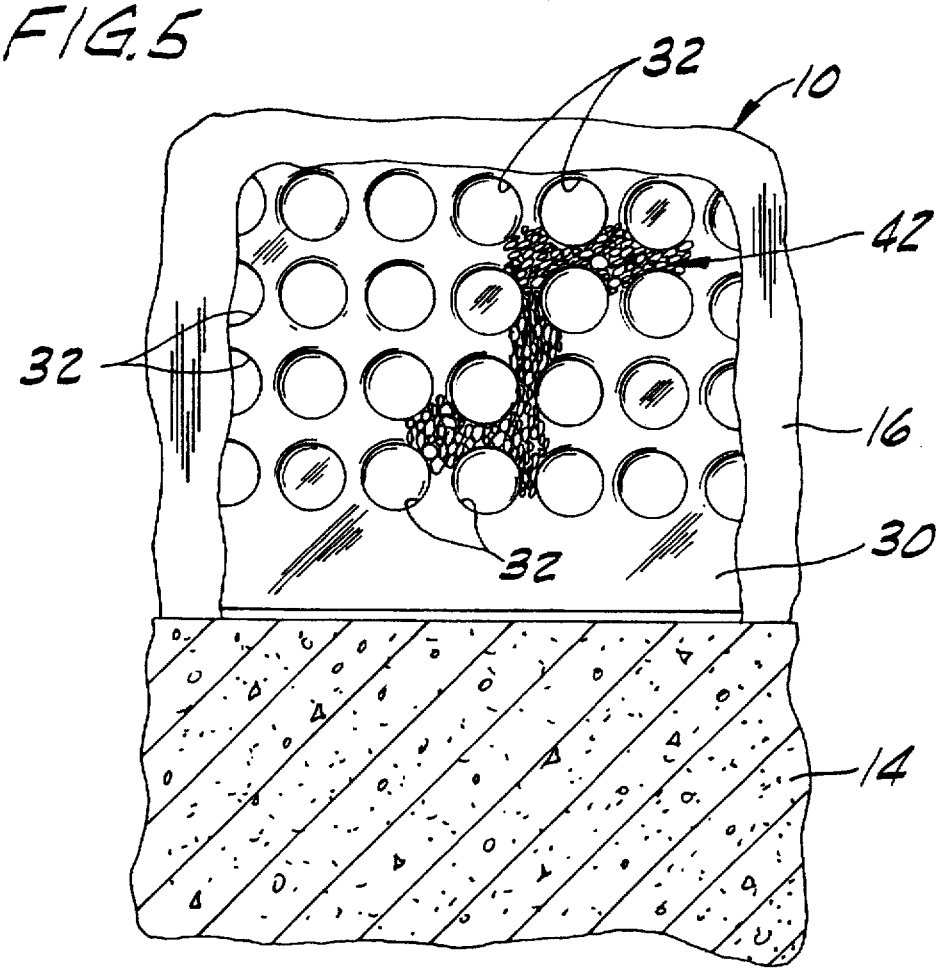
FIG. 5 is an enlarged, fragmentary plan view of the drainage device and structure of FIG. 1 showing partial blockage of a fluid flow channel.

The wall member 30 and feet 32 are formed of a material capable of transmitting light in the visual range so that any foreign matter (indicated generally at 42) located below the wall member and potentially blocking the channels 40 will be apparent upon visual inspection prior to installing the floor over the drainage device (FIG. 5). The material may be transparent or translucent so long as a person is able to visually detect any foreign matter in the fluid flow channels 40 after the drainage device 10 is installed. The transparency or translucency of the drainage devices will allow a person prior to pouring the floor material to visually inspect all flow passages 40 for dirt, mud, debris or any other foreign matter 42 that could potentially block a flow passage and prevent water from freely flowing to the drain 18.

The drainage device 10 further comprises a flap 44 extending upwardly from the wall member 30. When the drainage device 10 is installed, the flap 44 is positioned in generally face-to-face relation with the foundation wall 14. The flap 44 extends upwardly from the wall member 30 at a 90° angle as shown in FIG. 2. The flap 44 is attached to the foundation wall 14 by masonry nails 46 or any other suitable fastener driven through the flap and into the wall. After securing the flap 44 to the foundation wall 14, the device is further secured by attaching a selected number of feet 32 to the footing 16 by a nail 46 or any other suitable fastener. The flap 44 could also extend from the wall member 30 at an angle less than 90°, or be partially curved and have a vertical portion which could be used to attach the flap to the foundation wall 14. The flap 44 is preferably integrally formed with the wall member 30, but may be separately formed and attached to the wall member by any suitable means. The flap 44 provides an additional barrier to prevent the water from travelling up the side of the foundation wall 14.

To install the drainage device 10 of this invention, the first drainage device is placed over a portion of the footing 16 with the flap 44 adjacent the foundation wall 14. A masonry nail 46 is driven through the flap 44 and into the foundation wall 14 to hold the drainage device in place. A second drainage device is then placed over the footing 16 such that an end margin 48 of the second drainage device overlies an end margin of the other adjacent drainage device and feet 32 located within the edge margin of the second drainage device nest in feet within the edge margin of the first drainage device, as shown in FIG. 4. Preferably, at least three rows of feet 32 should overlap one another. A nail 46 is then driven through the flap 44 of the second drainage device to secure it to the foundation wall 14. Nails 46 may also be driven through the bottom walls 32 of one or more of the overlapping feet 32 of the first and second drainage devices and through additional feet in each drainage device to further secure the devices to the footing 16. It may be necessary to cut the last drainage device installed along one edge of the footing 16 so that it properly abuts the adjacent foundation wall 14. Alternatively, the number of overlapping feet 32 may be increased to accommodate the appropriate length. The feet 32 of the drainage devices located at the corners of the structure are nested into the adjoining drainage device located along the adjacent wall as required to cover the footing 16. An opening is cut into the two drainage devices located in the corner of the structure where the drain 18 is located to fit around the drain and allow flow into the drain.

After the drainage devices 10 are installed over the exposed footing 16 and before the floor material is poured, all the drainage devices are visually inspected from above for blockage of the flow channels 40. This visual inspection is preferably done immediately prior or very close in time to the pouring of the floor material so that foreign matter 42 is not given time to accumulate in a flow channel 40 prior to pouring the floor. One or more persons walk around the entire interior perimeter of the structure and visually inspect each drainage device 10, looking for dirt, mud, debris or any other foreign matter 42 which can block or restrict a flow passage 40. If any matter is found, the appropriate nail 46 or nails are removed to pull back a section of the drainage device away from the footing 16 to allow someone to either reach underneath the drainage device and remove the foreign matter, or use a shovel or other suitable tool to remove the foreign matter. If required, an entire device or number of devices may be removed if a large amount of foreign matter is observed under the device. After cleaning away the foreign matter 42, the drainage device 10 is placed back over the footing 16 and the nails 46 which have been removed are replaced to once again secure the drainage device in place. After the inspection is complete and all foreign matter has been removed, the floor material is poured to complete the basement.

As described above, the drainage device 10 provides a simple, accurate and rapid way to inspect drainage systems after installation and before pouring the floor material to avoid possible blockage of the flow passageways which can cause inadequate draining of water and moisture entering a structure resulting in a wet basement floor. In contrast, prior devices required either lifting of the devices away from the footing to check for foreign matter or feeling for foreign matter by reaching underneath the devices. The prior devices and methods were time consuming, dangerous and often imprecise. The present drainage device 10 provides for a quick, easy and accurate way to visually inspect all flow channels without physically removing and replacing each device or reaching underneath each device and risking injury from sharp objects.

In view of the above, it will be seen that the several objects of the invention are achieved and other advantageous results attained.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A drainage device for use under a floor in a structure including the floor, a foundation wall, a footing located below the foundation wall and a drain, the drainage device being constructed for placement on the footing adjacent to the foundation wall prior to installation of the floor to permit water to flow along the footing under the floor to the drain, the drainage device comprising a wall member and spaced apart feet depending from the wall member, the feet being engageable with the footing at spaced apart locations for vertically spacing the wall member from the footing, the feet defining fluid flow channels for water seeping from between the foundation wall and the footing and allowing water to flow freely underneath the floor and along the footing toward the drain, said wall member being formed of a material capable of transmitting light in the visual range so that any foreign matter located below the wall member and potentially blocking the channels will be apparent upon visual inspection prior to installing the floor over the drainage device.

2. A drainage device as set forth in claim 1 wherein the wall member and feet are formed as a single piece from the material capable of transmitting light in the visual range.

3. A drainage device as set forth in claim 2 wherein the material of the wall member and feet is transparent.

4. A drainage device as set forth in claim 2 wherein the material of the wall member and feet is translucent.

5. A drainage device as set forth in claim 1 further comprising a flap extending upwardly from an edge of the wall member, the flap being engageable with the foundation wall for use in securing the device to the wall.

6. A drainage device as set forth in claim 5 wherein said flap extends from the wall member at about a 90° angle.

7. A drainage device as set forth in claim 5 wherein the wall member, feet and flap are formed as a single piece from the material capable of transmitting light in the visual range.

8. A drainage device as set forth in claim 1 wherein the feet are hollow and open upwardly through the wall member for receiving material poured to form the floor whereby the weight of the floor is supported by the floor material within the feet and not by the wall member.

9. A drainage device as set forth in claim 8 wherein the feet are cylindrically shaped and have a diameter greater than about 0.625 inches.

10. A drainage device as set forth in claim 1 wherein said device is sized to extend from the foundation wall outwardly past an edge of the footing.

11. A method for installing a floor and drainage system comprising drainage devices under the floor in a structure including the floor, a foundation wall, a footing located below the foundation wall and a drain, each of the drainage devices being constructed for placement on the footing adjacent to the foundation wall prior to installation of the floor to permit water to flow along the footing under the floor to the drain, said method comprising the following steps:

placing the drainage devices adjacent to one another on the footing so that the drainage devices substantially cover the exposed footing, each drainage device being at least partially formed of a material capable of transmitting light in the visual range so that any foreign matter located below the drainage device and potentially blocking the flow of water along the footing will be apparent upon visual inspection from above the drainage devices prior to installing the floor over the drainage devices;

visually inspecting said flow channels from above the footing by looking through the drainage devices to detect blockage of the flow channels;

pouring material to form the floor over the drainage devices if the visually inspected flow channels are free of blockage.

12. A method for installing a floor and drainage system as set forth in claim 11 further comprising the step of removing any blockage detected during said visual inspection step.

13. A method for installing a floor and drainage system as set forth in claim 12 wherein the step of removing blockage comprises the steps of removing at least a portion of one of the drainage devices from the footing, cleaning away matter forming the blockage from one or both of said drainage device portion and the footing, and replacing said drainage device portion of the footing.

14. A method for installing a floor and drainage system as set forth in claim 13 wherein the step of placing the drainage devices on the footing and the step of replacing said drainage device portion of the footing both include the step of securing at least said drainage device portion to one or both of the foundation wall and footing.

15. A method for installing a floor and drainage system as set forth in claim 14 wherein each drainage device comprises a flap extending upwardly from an edge of the drainage device, and wherein the step of placing the drainage device on the footing includes positioning the flap in generally face-to-face relation with the foundation wall.

16. A method for installing a floor and drainage system as set forth in claim 13 wherein the drainage devices each further comprise spaced apart feet engageable with the footing for supporting the drainage device and defining liquid flow channels under the drainage device, the feet of one of the adjacent drainage devices being nestable in the feet of another adjacent one of the drainage devices, and wherein the step of placing the drainage devices on the footing comprises the steps of placing adjacent drainage devices such that an end margin of said one of the adjacent drainage devices overlaps an end margin of the other adjacent drainage devices, and nesting the feet of said one of the adjacent drainage devices in the feet of said other one of the adjacent drainage devices.

17. A method for installing a floor and drainage system as set forth in claim 13 wherein the drainage devices each include feet which are nestable in the feet of another adjacent one of the drainage devices, and wherein the step of placing the drainage devices on the footing comprises the steps of placing adjacent drainage devices such that an end margin of one of the adjacent drainage devices overlaps an end margin of another adjacent one of the adjacent drainage devices, and nesting at least three rows of feet of said one of the adjacent drainage devices in the feet of said other one of the adjacent drainage devices.

18. A method for installing a floor and drainage system as set forth in claim 11 wherein the drainage devices are made of material which is transparent.

19. A method for installing a floor and drainage system as set forth in claim 11 wherein the drainage devices are made of material which is translucent.

20. A method for installing a floor and drainage system as set forth in claim 11 further comprising placing the drainage devices so that the drainage devices extend outwardly from the foundation wall beyond an edge of the footing.

* * * * *